United States Patent [19]

Nilsson

[11] Patent Number: 5,040,288

[45] Date of Patent: Aug. 20, 1991

[54] PRESS TOOL

[75] Inventor: Mikael Nilsson, Alvdalen, Sweden

[73] Assignee: Pressmaster Tool AB, Alvdalen, Sweden

[21] Appl. No.: 650,624

[22] Filed: Feb. 5, 1991

[30] Foreign Application Priority Data

Feb. 5, 1990 [SE] Sweden ..... 9000399

[51] Int. Cl.[5] ..... H01R 43/04

[52] U.S. Cl. ..... 29/751; 29/753; 81/398; 81/402

[58] Field of Search ..... 29/751, 753, 267, 268, 29/566.3, 566.4; 81/388–390, 402–404, 395, 398

[56] References Cited

U.S. PATENT DOCUMENTS 2,691,911 10/1954 Gren ..... 81/398 X
4,784,669 11/1988 Maack ..... 29/566.4

FOREIGN PATENT DOCUMENTS 2002281 7/1971 Fed. Rep. of Germany .
3615087 1/1987 Fed. Rep. of Germany .

*Primary Examiner*—Carl E. Hall
*Attorney, Agent, or Firm*—Fleit, Jacobson, Cohn, Price, Holman & Stern

[57] ABSTRACT

A tool for crimping a connector onto a cable includes a crimping device which is mounted on a forward end of an axially movable piston, and a localizing device for detachably holding a cable and a connector in position for coaction with the crimping device while crimping the connector onto the cable. The piston is journalled in a hollow spindle and is driven reciprocatingly at a predetermined length of stroke by means of a drive mechanism. The tool further has a distance setting means, including an external screw thread on the spindle and a nut surrounding the spindle and engaging the screw thread thereof, for continuous setting of the distance between the crimping device, when the piston is located in its retracted position, and the localizing device.

6 Claims, 3 Drawing Sheets

PRESS TOOL

The present invention relates to a tool for crimping or pressing a connector onto a cable. The tool is of the kind which includes a crimping or pressing device which can be moved reciprocatingly by means of a drive mechanism, a localizing device which is operative to hold a cable and a connector in position for coaction with the crimping device while crimpinq or pressing the connector onto the cable, and a distance setting device for continuous setting of the distance between the crimping or pressing device, when said device is is in its retracted position, and said localizing device. The invention pertains primarily to a tool for crimping a connector onto so-called semi-rigid cables intended for high-precision installations within, for instance, the aircraft and spacecraft manufacturing industries, although it can also be used for pressing or crimping less sophisticated connectors to cables and other conductors.

A large number of different types of connectors intended to be pressed onto conductors of different kinds are known to the art. High mechanical and electrical requirements may be placed on the connection established between connector and conductor, which in many cases has necessitated the use of a special duty tool by means of which the connector can be pressed onto the cable. These special duty tools are only useful for a small assortment of connectors.

The object of the present invention is to provide a novel and useful crimping tool which is configured so as to enable the tool to be readily adapted for use with a relatively large assortment of connectors.

Accordingly it is suggested in accordance with the present invention that in the case of a tool of the aforedescribed kind the connector crimping device is mounted on the forward end of a piston which can be moved reciprocatingly through a predetermined length of stroke by means of a drive mechanism in the direction of the longitudinal axis of said piston, and that the localizing device is carried by a holding device which, in turn, is carried by and is continuously adjustable along a hollow spindle which is carried by a basic tool unit incorporating said drive mechanism and in which the piston is journalled for longitudinal movement, and that the hollow spindle is provide with an external screw thread which meshes with a nut surrounding the spindle and carried by the holding device, the spindle and the nut being rotatable relative to one another.

This enables one and the same basic tool to be used for securing connectors with which fastening of said connectors requires mutually different lengths of stroke of the crimpling device subsequent to commencement of the actual crimping process.

The tool may be provided with graduations which indicate the setting of the localizing device, so as to enable the tool to be readily set to the length of stroke prescribed by the manufacturer of respective connectors. In this respect, graduations which indicate the setting of the localizing device may include a scale which indicates the position of the nut along the spindle, and a scale which indicates the rotational positions of the nut and spindle in relation to one another.

According to one advantageous feature of the invention, the length of the piston can be adjusted from without. between the crimping device, when the piston is located in its retracted position, and the localizing device, but is preferably utilized, when some other distance setting device and position indicating graduations are present, for mutually setting the position of the piston and the graduations, for instance, so that the graduations shows zero when the piston is located in its fully retracted position.

Further features of the invention and advantages afforded thereby are set forth in the depending claims and are evident from the following description of preferred exemplifying embodiments of the inventive tool illustrated in the accompanying drawings.

Figure 1:
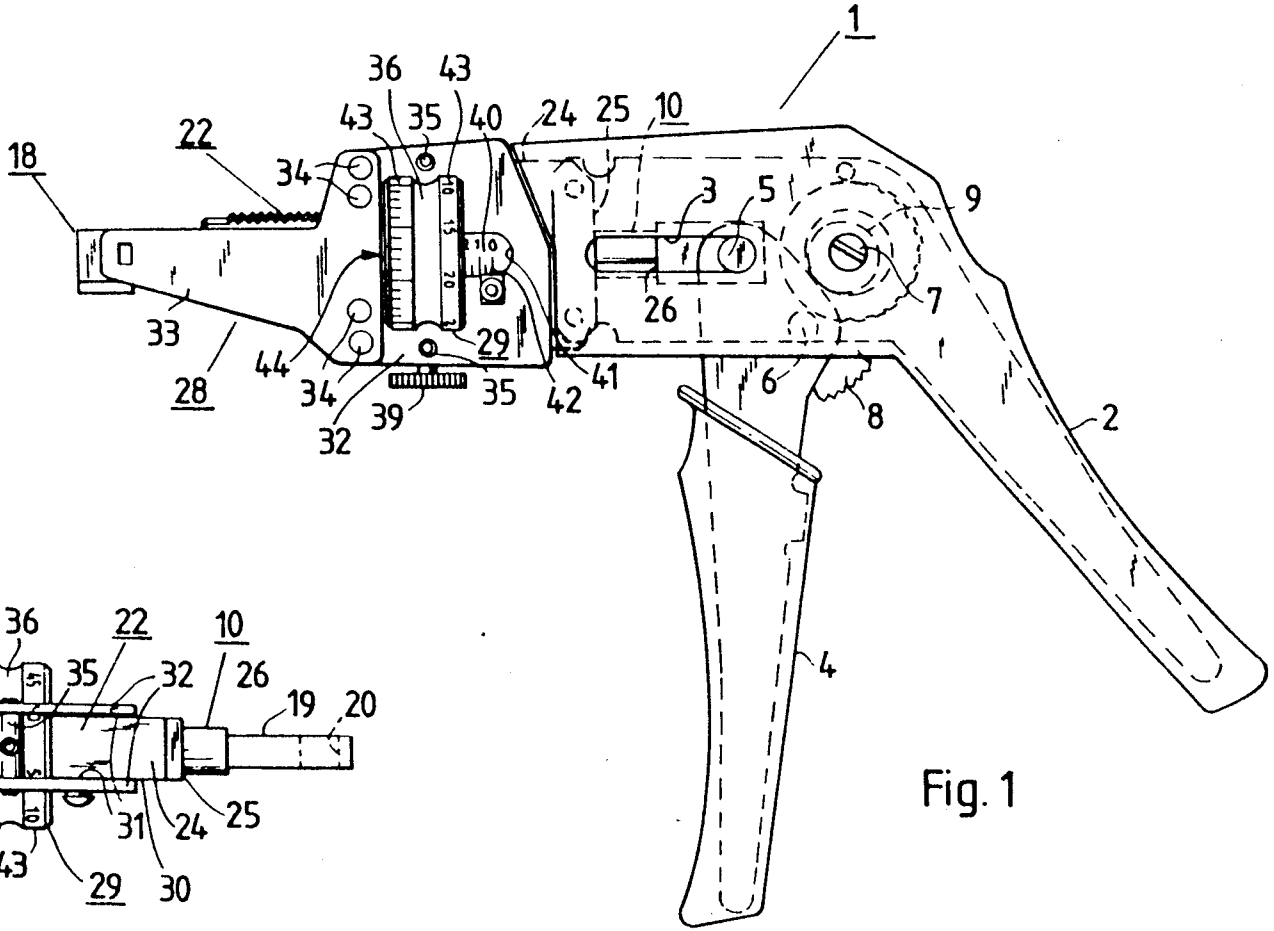
FIG. 1 is a side view of a tool constructed in accordance with the invention.
Figure 2:
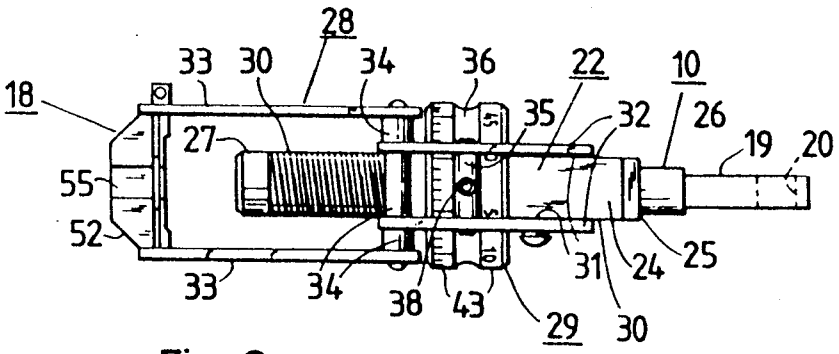
FIG. 2 is a top view of the tool shown in FIG. 1 with the actual tool base unit excluded.

Like or corresponding details in the various Figures have been identified with mutually the same reference signs. In FIG. 1, the reference numeral 1 identifies generally a tool base unit of known construction. The base unit 1 comprises a body having a fixed handle 2 and a slot-like guide 3 in which there is mounted a pin 5 which projects outwardly from a pivotal handle 4, such that the pin 5 can move transversely to its longitudinal axis. A link arm, of which a part is visible at 8, extends between a further pin 6 on the movable handle 4 and a pin 7 carried by the tool body 1. It will be seen that the arm 8 extending between the pins 6 and 7 and the part of the handle 4 extending between the pins 5 and 6 form a toggle-lever tool which can be operated by means of the remainder of the handle 4. When the handle 4 is swung towards the handle 2, as seen in FIG. 1, the pin 5 will move to the left in the guide 3. A return spring (not shown) acts between the lever arm 8 and the tool body in a manner such as to endeavour to pivot the arm 8 around the pin 7 in an anti-clockwise direction, until the pin 5 abuts the right end of the guide 3. The arm 8 is journalled on a centre part 9 of the pin 7, which is excentric in relation to the remainder of the pin 7, said pin 7 being rotatable to and lockable in desired rotational positions for the purpose of positionally adjusting the tool base unit 1, for instance for compensating for wear in the journals between the handle 4, the link arm 8 and the tool body. Although not shown, the tool base unit 1 is also provided with a known device which, when the tool is in use, prevents the handle 4 from returning to the illustrated position until the handle 4 has been swung towards the handle 2 to a predetermined extent. The handle 4 and the toggle-lever tool form a drive mechanism operative to drive a piston, generally referenced 10 in FIGS. 2–4, in the direction of its longitudinal axis. The forward end of the piston 10 carries a crimping device 11, shown only in FIG. 3. The rear part of the device 11 is accommodated in a recess 12 in the piston 10 and is provided with a circular groove 13.

The forward end of the piston 10 is provided with a further circular groove 14 (FIG. 4) which has provided around parts of its circumference, openings 15 which face towards the piston recess 12 and which are intended to receive a horseshoe-like spring (not shown) with parts of the spring extending through said openings and into the recess 12. These spring parts are intended to project into the circular groove 13 of the crimping device 11 so as to detachably hold the device in the recess 12. The device 11 is thus exchangeable and several mutually different crimping devices can be provided so as to enable the tool to be adapted to connectors of mutually different form and construction. When the device 11 is positioned correctly in the piston recess 12, a flange 16 on the device 11 will abut the front annular end surface 17 of the piston 10, said end surface surrounding the device receiving opening. The outer diameter of the flange 16 may coincide with the outer diameter of the piston 10.

The tool also includes a localizing device, generally identified at 18, for detachably holding a cable (not shown), for instance a so-called semi-rigid cable comprising an outer metal sheath, a central conductor and intermediate insulation, and a connector (not shown) in position for coaction with the crimping device 11 carried by the piston 10 while the connector is crimped onto the cable. The localizing device 18 is carried indirectly by the tool base unit 1. The tool further comprises a distance setting device of a kind hereinafter described, for continuous and smooth adjustment of the distance between the crimping device 11, when the piston 10 is located in its retracted position, and the localizing device 18, so as to enable the tool to be adapted to connectors and connector crimping devices of differing configurations.

Provided on the rear end of the piston 10 is an attachment part 19 whose width is smaller than the diameter of the otherwise cylindrical piston 10 and the height or thickness of which is greater than said diameter and which has a transversely extending, circular boring 20 into which there is fitted the cylindrical pin 5 of the handle 4, as illustrated in FIG. 1. The piston 10 is guided for axial movement in a circular boring 21 which extends axially through a spindle 22 device carried by the body of the base unit 1, the diameter of the boring corresponding to the diameter of the piston 10. In the case of the illustrated embodiment, the spindle device 22 is provided with a rearwardly located attachment block 23 through which the boring 21 also extends and which is provided with mounting holes 24 which are used to affix the spindle device to the tool base unit 1. When the spindle device 22 is fitted to the base unit 1 in the manner illustrated in FIG. 1, the rear surface 25 of the block 23 functions as a stop means and coacts with the front surface 26 of the attachment part 19 such as to determine the maximum forward position of piston displacement, whereas engagement between the pin 5 and the right end of the guide 3, according to FIG. 1, determines the maximum retracted position of the piston 10.

The part 27 of the spindle device 22 projecting forwardly from the block 23 carries a holder means, generally referenced 28, which in turn carries the localizing device 18. The holder means 28 can be positionally adjusted smoothly along the spindle part 27. Accordingly, in the illustrated case, the spindle part 27 has an external screw thread, best seen from FIGS. 2 and 3, which meshes with a nut 29 which embraces the spindle and which is carried by the holder means 28, said nut being rotatable, but axially immovable, in the holder means. In order to prevent the holder means 28 from rotating relative to the spindle part 27, said part is provided with flat, longitudinally extending guide surfaces 30 on opposite sides thereof, for instance face-ground surfaces, which abut parallel guide surfaces 31 on the holder means 28. More specifically, these surfaces 31 are formed by the mutually facing sides of two rear side plates 32 each of which is located on a respective side of the spindle device 22 and the forward ends of which are connected to a pair of forward side plates 33 which are located at a greater distance from one another than the rear side plates 32, and which carry the localizing device 18 on their forward ends. The side plates 32 and 33 are mutually connected with the aid of a number of pins or the like 34, 35, and the nut 29 extends laterally out through openings provided therefor in the rear side plates 32. The nut 29 is provided with a circumferential groove 36 which is located opposite the pins 35 extending between the side plates 32. Screws 38, 39 extend through screwthreaded holes which pass diametrically through the centre of respective pins 35, of which holes one is shown at 37 in FIG. 3. The tips of the screws 38, 39 are rounded so as to conform to the shape of the groove 36 and extend to the immediate vicinity of the groove bottom, so as to contribute towards mutual journalling of the holder means 28 and the nut 29. As illustrated in FIG. 1, the bottom screw 39 is provided with a relatively large, knurled head so as to enable the nut 29 to be tightened against rotation without the need of a tool herefor, when fixing the holder means 28, and therewith the localizing device 18, in a desired set position.

The reference numeral 40 identifies graduations or scale provided on a guide surface 30 and visible through an opening or a window 41 in a rear side plate 32. The graduations or scale is intended to coact with a mark 42 on the same side plate 32, so as to show the position of the holder means along the spindle device 22. In the illustrated case, further graduations or a further scale 43 is provided on the periphery of the nut 29, so as to facilitate fine adjustment of the holder means 28 in relation to the spindle device 22, said scale coacting with a mark 44 such as to indicate the rotational position of the nut 29 in relation to the spindle 22.

The excentric 9 illustrated in FIG. 1 can also be used to make adjustments such that the surface 26 of the piston 10 will truly come into contact with the rear surface 25 on the attachment block 23 of the spindle device 22 before the handle 4 is able to swing back from a depressed position to the illustrated starting position. The length of the piston 10 can be adjusted, so as to enable the graduation 40, 42–44 to be calibrated, for instance to that said graduations will indicate zero when the forward end of the piston 10 is located in a desired starting position. To this end, the piston 10 comprises two parts 45, 46, of which the one part 45 is provided with an internally threaded recess 47 and the other part is provided with an externally threaded, hollow pin 48 which grips in the recess 47. A thrust spring 49 accommodated in the recess 47 and the cavity or hollow of the pin 48 functions to increase the friction between the threads of the recess and the pin and therewith prevent unintentional rotation of the parts 45, 46 in relation to one another. In order to enable the length of the piston 10 to be adjusted while the piston is mounted in position in the tool, there is provided a key 50 (FIG. 3) having diametrically and outwardly projecting engagement means intended for engagement with corresponding, diametrically arranged groove parts 51 in the front end of the piston 10. Thus, the key 50 is used to rotate the front piston part 45 relative to the rear piston part 46, which is secured against rotation, until the desired piston length and desired starting position for the front end of the piston 10 are obtained, when the graduations 40, 42–44 are at zero. The tool can therewith be adjusted to suit mutually different crimping devices 11, by setting the graduations to a value prescribed by, for instance, the manufacturer of the device 11.

Figure 3:
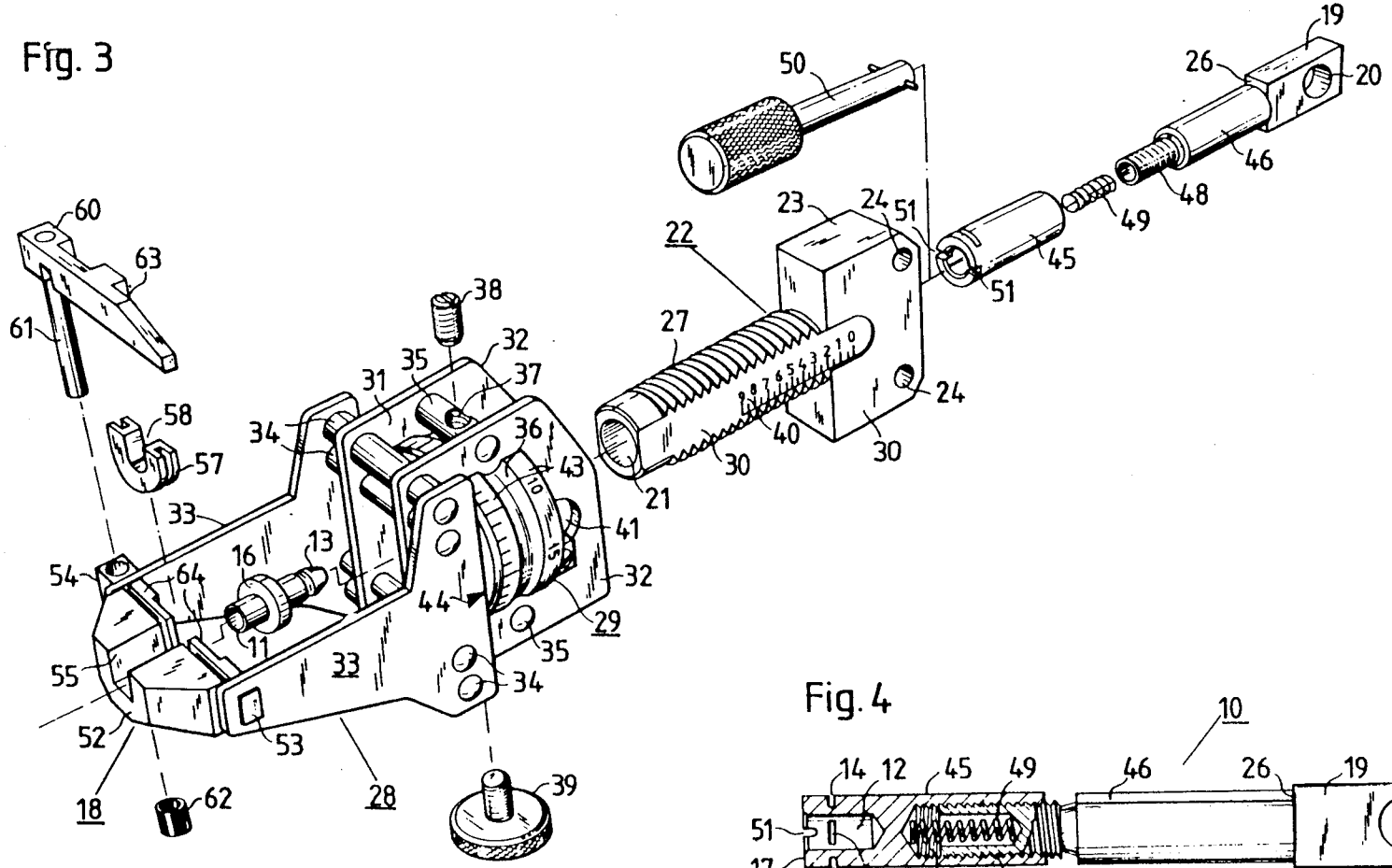
FIG. 3 is a perspective, exploded view of the arrangement shown in FIG. 2 in larger scale.
Figure 4:
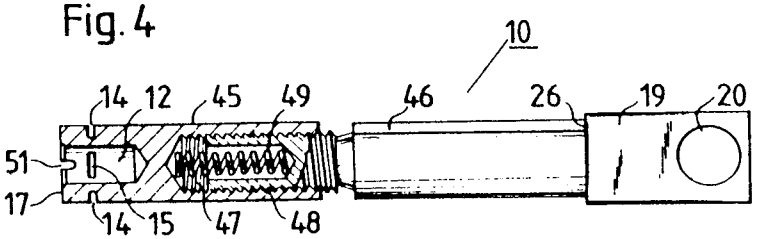
FIG. 4 is a side view of the tool piston, partially in section.
Figure 5:
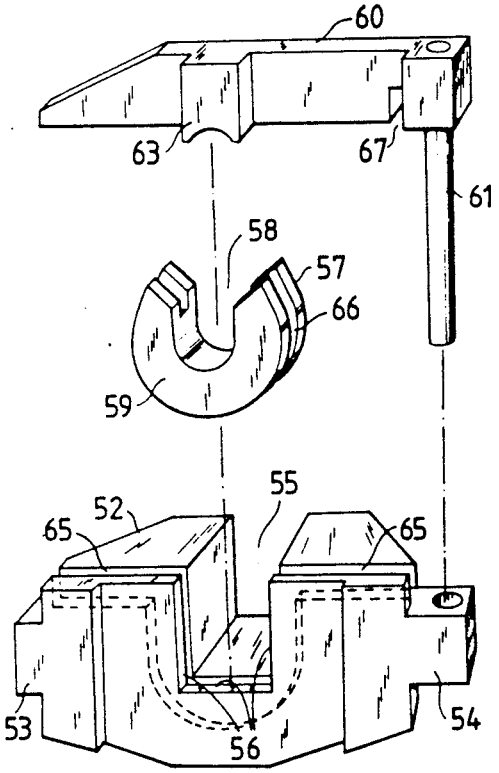
FIG. 5 is an exploded view in larger scale of a localizing device which is modified slightly in relation to the localizing device illustrated in FIG. 3.
Figure 6:
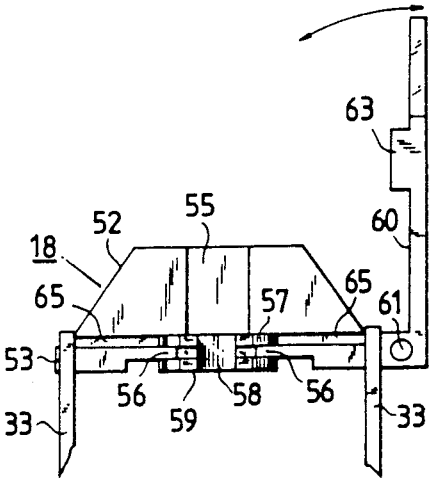
FIG. 6 is a top view of the localizing device illustrated in FIG. 5.

In the case of the embodiment illustrated in FIGS. 3, 5 and 6, the localizing device 18 comprises a block 52 which extends between the forward ends of the forward side plates 33 and which has parts 53, 54 which fit into and through openings in the plates 33. The block 52 is provided with a channel 55 which is arranged in line with movement of the piston 10 and which has on the side thereof facing the piston 10 a fitting 56 for receiving an exchangeable localizing device 57. This latter device is provided with a groove 58 which extends parallel with the channel 55 and which fits a cable (not shown), said cable having fitted on one end thereof a connector device which is to be pressed or crimped onto the cable with the aid of the device 11 mounted on the piston 10, as the piston is moved forwards. The side 59 of the localizing device 57 facing towards the piston 10 and the device 11 functions as an anvil surface for exerting a counterpressure on the connector as is is crimped onto the cable. A plurality of different, detachably mountable localizing devices 57 can be used with the tool, so as to enable the tool to be adapted to different cable and connector configurations.

A cable is held detachably in the groove 58 in the anvil 57 by means of a crosspiece 60 which is provided with a downwardly extending bearing pin 61 at one end thereof. The bearing pin 61 extends displaceably through a boring in the part 54 of the block 52 extending externally of a front plate 33. As indicated in FIG. 3, the illustrated tool may be provided with a sleeve 62, for instance a rubber or plastic sleeve, which can be fitted onto the bottom end of the bearing pin 61 extending through the boring in said part 54, therewith to prevent the pin 61 from accidentally sliding from said boring. Provided on the undersurface of the cross-piece 60 is an anvil part 63 which complements the anvil 57, and the cross-piece is, in its working position, supported by a shoulder 64 (FIG. 3) on or in a groove 65 (FIG. 5) in the block 52. Subsequent to crimping a connector onto one end of a cable, the crosspiece 60 is lifted and swung through 90°, 180° or 270° to a position in which it extends forwards, in accordance with FIG. 6, to the right in FIG. 6, or rearwardly in FIG. 6, parallel with the closely adjacent forward side plate 33. In the embodiment illustrated in FIGS. 5 and 6, the fitting 56 comprises a wall part which is intended to project into a groove 66 in the sides and bottom part of the localizing device 57. When swung out to its 90°, 180°, or 270° position, the crosspiece 60 can support against the outer surface of the closely adjacent forward side plate 33, subsequent to being lowered against the upper surface of said part 54, so as to lock the crosspiece against rotation. This arrangement is clearly seen from FIGS. 5 and 6. In FIG. 5, the reference numeral 67 identifies a recess formed in that end of the crosspiece 60 located adjacent the pin 61, said recess being intended to receive said side plate 33 when the crosspiece 60 is located in its working position.

The invention is not restricted to the aforedescribed and illustrated embodiments, but can be realized in any manner that lies within the scope of the inventive concept defined in the following claims.

I claim:

1. A tool for crimping or pressing a connector onto a cable, comprising a connector crimping device mounted on a forward end of a piston which is moved reciprocatingly in its axial direction by a drive mechanism over a predetermined length of stroke between a retracted position and a forward position a localizing device for supporting a cable and a connector in position for coaction with the crimping device while crimping the connector onto the cable, and a distance setting device for continuous setting of the distance between the crimping device, when said device is located in its retracted position, and said localizing device, wherein the localizing device is carried by a holding device which, in turn, is carried by and is continuously adjustable along a hollow spindle which is carried by a tool base unit incorporating said drive mechanism and in which the piston is journalled for axial movement; and wherein the hollow spindle is provided with an external screw thread which meshes with a nut surrounding the spindle and carried by the holding device, the spindle and the nut being rotatable in relation to one another.

2. A tool according to claim 1, wherein the spindle is non-rotatably mounted in the tool base unit, and wherein the nut is rotatably but axially immovably mounted in the holding device, which in turn is non-rotatable relative to the spindle axis.

3. A tool according to claim 2, wherein the spindle is provided with at least one, longitudinally extending flat guide surface which is in contact with a parallel guide surface on the holding device such as to prevent rotation of the holding device relative to the non-rotable spindle.

4. A tool according to claim 1 wherein graduations indicating the positional setting of the localizing device include a scale which shows the position of the nut along the spindle, and a scale which shows the position of rotation of the nut and the spindle in relation to one another.

5. A tool according to claim 2, wherein the nut can be locked against rotation.

6. A tool according to claim 1, wherein the length of the piston can be adjusted from without.

* * * * *